US005864210A

United States Patent [19]

Hochi et al.

[11] Patent Number: 5,864,210

[45] Date of Patent: Jan. 26, 1999

[54] ELECTRODELESS HID LAMP AND ELECTRODELESS HID LAMP SYSTEM USING THE SAME

[75] Inventors: Akira Hochi, Nara; Shigeru Horii, Takatsuki; Mamoru Takeda, Soraku-gun; Tomizo Matsuoka, Neyagawa, all of Japan

[73] Assignee: Matsushita Electric Industrial Co., Ltd., Osaka, Japan

[21] Appl. No.: 701,670

[22] Filed: Aug. 22, 1996

[30] Foreign Application Priority Data

Aug. 24, 1995 [JP] Japan ..... 7-215835

[51] Int. Cl.[6] ..... H01J 17/20

[52] U.S. Cl. ..... 313/641; 313/637; 313/571

[58] Field of Search ..... 313/571, 622, 313/638, 640, 641, 642, 643

[56] References Cited

U.S. PATENT DOCUMENTS

| | | | |
|---|---|---|---|
| 3,259,777 | 7/1966 | Fridrich . | |
| 3,714,493 | 1/1973 | Fridich . | |
| 3,897,594 | 7/1975 | Popp et al. . | |
| 4,401,914 | 8/1983 | Wesselink et al. | 313/610 |
| 4,581,557 | 4/1986 | Johnson | 313/639 |
| 4,808,882 | 2/1989 | Parker et al. | 313/625 |
| 4,874,988 | 10/1989 | English et al. | 313/620 |
| 4,922,157 | 5/1990 | Van Engen et al. | 313/493 |
| 5,032,757 | 7/1991 | Witting | 313/44 |
| 5,113,121 | 5/1992 | Lapatovich et al. | 313/248 |
| 5,404,076 | 4/1995 | Dolan et al. . | |
| 5,479,072 | 12/1995 | Dakin et al. | 313/638 |
| 5,661,365 | 8/1997 | Turner | 313/638 |

FOREIGN PATENT DOCUMENTS

| | | |
|---|---|---|
| 671 014 | 4/1966 | Belgium . |
| 0 128 550 | 12/1984 | European Pat. Off. . |
| 0 342 762 | 11/1989 | European Pat. Off. . |
| 0 420 335 | 4/1991 | European Pat. Off. . |
| 1 544 036 | 10/1968 | France . |
| 1 587 119 | 3/1970 | France . |
| 1 286 637 | 1/1969 | Germany . |
| 1 464 181 | 10/1969 | Germany . |
| 25 4270 | 2/1988 | Germany . |
| 52-031583 | 3/1977 | Japan . |
| 55-062653 | 5/1980 | Japan . |
| 6-0235353 | 11/1985 | Japan . |
| 2 237 927 | 5/1991 | United Kingdom . |
| 93/21655 | 10/1993 | WIPO . |

OTHER PUBLICATIONS

T. Higashi, "Radiation Characteristics of Metal Halide Lamps with Rare Earth Halide Additives", *Journal of the Illumination Engineering Institute of Japan,* vol. 65, No. 10, pp. 487–492 (1981).

D.C. Fromm, et al., "A Metal Halide High Pressure Discharge Lamp with Warm White Colour and High Efficacy", *Lighting Research and Technology,* vol. 11, No. 1, pp. 1–8 (1979).

*Primary Examiner*—Max H. Noori
*Attorney, Agent, or Firm*—Ratner & Prestia

[57] ABSTRACT

The apparatus has a light transmitting bulb for confining a discharge therein, a fill sealed within the light transmitting bulb and including a rare gas and a metal halide emitting a continuous spectrum by molecular radiation, and a discharge excitation source for applying electrical energy to the fill and for starting and sustaining an arc discharge, and the metal halide includes one kind of halide selected from the group consisting of an indium halide, a gallium halide, and a thallium halide, or a mixture thereof, and in that the light transmitting bulb has no electrodes exposed in discharge space and further this construction utilizes the continuous spectrum of molecular radiation of the metal halide and thereby achieves high color rendering properties and high luminous efficacy simultaneously without using mercury as the fill.

10 Claims, 7 Drawing Sheets

ELECTRODELESS HID LAMP AND ELECTRODELESS HID LAMP SYSTEM USING THE SAME

BACKGROUND OF THE INVENTION

1. Field of the Invention

The present invention relates to a high-intensity-discharge (HID) lamp in which a metal halide continuously emitting light by molecular radiation is sealed within a light transmitting bulb and light is produced by arc discharge, thereby achieving outstanding color rendering properties and high efficacy.

2. Related Art of the Invention

In recent years, HID lamps, and in particular, metal halide lamps, have been replacing halogen lamps as high-output point light sources in various applications including stage and television lighting and liquid-crystal video projector light sources because of their high efficacy and excellent color rendering properties. This type of lamp is also finding application in sports lighting for HDTV broadcasting, lighting in museums and art galleries, etc. by utilizing its excellent color rendering properties. Metal halide lamps, however, contain mercury as a fill in large quantities amounting to several tens of milligrams per cubic centimeter of content volume, and it is strongly desired to eliminate mercury from the viewpoint of environmental preservation.

Compared with electrode arc discharge lamp systems, electrodeless discharge lamp systems have the advantage that electromagnetic energy can be easily coupled to the fill and it is therefore easy to eliminate mercury from the fill used for light emission by discharge. Furthermore, since there are no electrodes within discharge space, blackening of bulb inner walls due to electrode evaporation does not occur. This significantly improves lamp life.

Non-mercury fills for prior art HID lamps will be described below by way of example. In the electrodeless discharge lamp disclosed in Japanese Patent Unexamined Publication No. 3-152852, xenon is used as a discharge gas, and LiI, NaI, TlI, InI, etc. as luminescent substances are sealed within the lamp, producing white light by combining monochromatic line spectra radiated from these luminescent substances. This prior art discloses as a discharge excitation means a means by inductively coupling RF energy.

In the high power lamp disclosed in Japanese Patent Unexamined Publication No. 6-132018 (U.S. Pat. No. 5,404,076), $S_2$, $Se_2$, etc. as luminescent substances are sealed within the lamp, and a greenish white light is produced from the continuous spectrum of molecular radiation. This prior art discloses a discharge excitation means utilizing microwave energy.

Furthermore, U.S. Pat. No. 3,259,777 discloses an invention relating to an electroded metal halide lamp that employs a fill belonging to a metal halide, such as indium iodide used in the present invention. In this prior art, the lamp is operated using electrical energy high enough to heat the electrodes nearly to their melting point in order to cause the metal halide, such as indium iodide, to discharge at high power.

However, the electrodeless discharge lamp disclosed in Japanese Patent Unexamined Publication No. 3-152852 has had the problem that if the proportions of Na and Tl that emit light in regions of high spectral luminous efficiency are increased to increase efficacy, color rendering properties degrades, and if the color rendering properties are to be enhanced, the efficacy has to be decreased. Another problem that has been pointed out is that indium and thallium iodides produce a continuous spectrum at high pressure with a resultant decrease in line spectral causing a color shift. Furthermore, the light characteristics produced by a combination of line spectra, such as disclosed in Japanese Patent Unexamined Publication No. 3-152852, have poor color reproducibility, and it is difficult to obtain satisfactory color rendering properties.

With the high power lamp disclosed in Japanese Patent Unexamined Publication No. 6-132018, even if the kind of gas and the conditions of the fill are changed, chromaticity is always displaced from the black body locus substantially toward green, and it is not possible to obtain a satisfactory white light. A method that can be considered to improve the color characteristics of the high power lamp in Japanese Patent Unexamined Publication No. 6-132018 is to add some kind of metal compound as a luminescent substance and thereby add a line spectrum to change the chromaticity. However, metal sulphides produced by reaction of the added metal compound with sulphur are often relatively stable and low in vapor pressure and are difficult to turn into a plasma. This has lead to the problem that the kinds of metals that can be added are limited, reducing freedom in light color design and making it difficult to improve color rendering properties. Furthermore, when the spectral characteristics of the emission is changed by adding a fill or by using a color temperature conversion filter, spectral emission intensity increases in regions, other than green, where spectral luminous efficiency is low, necessarily resulting in a decrease in efficacy.

In U.S. Pat. No. 3,259,777, on the other hand, for lamp operation with electrodes and with non-mercury fills a considerable load is applied to the electrodes since the lamp is operated near the melting point of the electrodes. With this lamp design, therefore, rapid blackening of bulb inner walls occurs because of electrode evaporation, and a marked drop in lamp life is inevitable.

SUMMARY OF THE INVENTION

The present invention is intended to overcome the above-outlined problems with the prior art discharge excitation means and fills used as luminescent substances for discharge, and it is an object of the invention to provide an electrodeless high-intensity-discharge lamp that employs as a fill a luminescent material containing no mercury and providing high efficacy and high color rendering properties at the same time, by actively utilizing the continuous spectrum of molecular radiation that metal halides, such as indium, gallium, and thallium halides, emit at high pressure.

An electrodeless HID (high-intensity-discharge) lamp comprises a light transmitting bulb for confining a discharge therein;

a fill sealed within said light transmitting bulb and including a rare gas and a metal halide emitting a continuous spectrum by molecular radiation; and a discharge excitation means for applying electrical energy to said fill and for starting and sustaining an arc discharge;

wherein said metal halide includes one kind of halide selected from the group consisting of an indium halide, a gallium halide, and a thallium halide, or a mixture thereof and said light transmitting bulb has no electrodes exposed in discharge space.

An electrodeless HID lamp comprises a light transmitting bulb for confining a discharge therein;

a fill sealed within said light transmitting bulb and including zinc, a rare gas, and a metal halide emitting a continuous spectrum by molecular radiation; and a discharge excitation means for applying electrical energy to said fill and for starting and sustaining an arc discharge;

wherein said metal halide includes one kind of halide selected from the group consisting of an indium halide, a gallium halide, and a thallium halide, or a mixture thereof, and said light transmitting bulb has no electrodes exposed in discharge space.

Typical rare gases used in this invention would include: xenon, argon, and krypton, among others.

[DESCRIPTION OF THE REFERENCE NUMERALS]

21. BULB,

22. FILL,

24. MICROWAVE CAVITY,

27. MAGNETRON

DESCRIPTION OF THE PREFERRED EMBODIMENTS

The preferred embodiments of the present invention will be described below with reference to the accompanying drawings.

(Embodiment 1)

Figure 1:
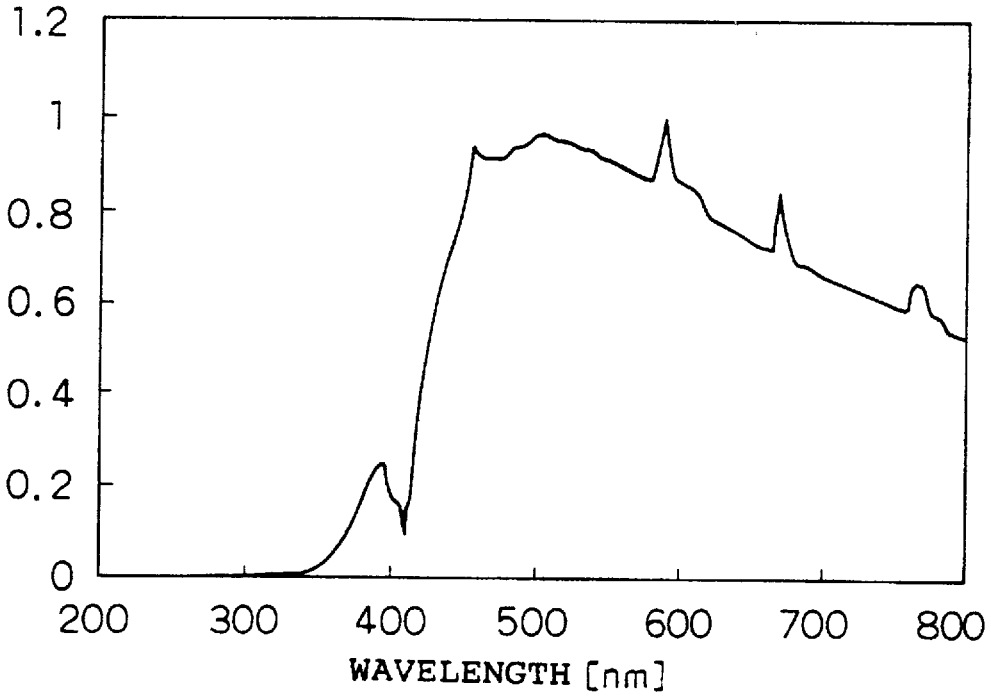
FIG. 1 is a diagram showing the emission spectrum of an electrodeless discharge lamp filled with indium iodide and argon according to a first embodiment of the present invention.

A first embodiment of the present invention will be described below with reference to drawings. FIG. 1 shows an emission spectrum obtained when a lamp, constructed with a spherical electrodeless discharge bulb of quartz glass having an inner diameter of 3.8 cm and filled with argon gas at 5 torr and indium iodide (InI) at $2.2\times10^{-5}$ mol/cm per unit length of the inner diameter corresponding to the inner wall-to-wall distance of the bulb in the direction of an electric field, was operated in a microwave electrodeless HID lamp system, such as the one shown in FIG. 2, with an input microwave energy of 800 W to produce light by discharge. The emission spectra shown here and in other parts of this specification are all a plot of the intensity of radiation measured at intervals of 5 nm, with the maximum value of the emission intensity rated at 1.

Figure 2:
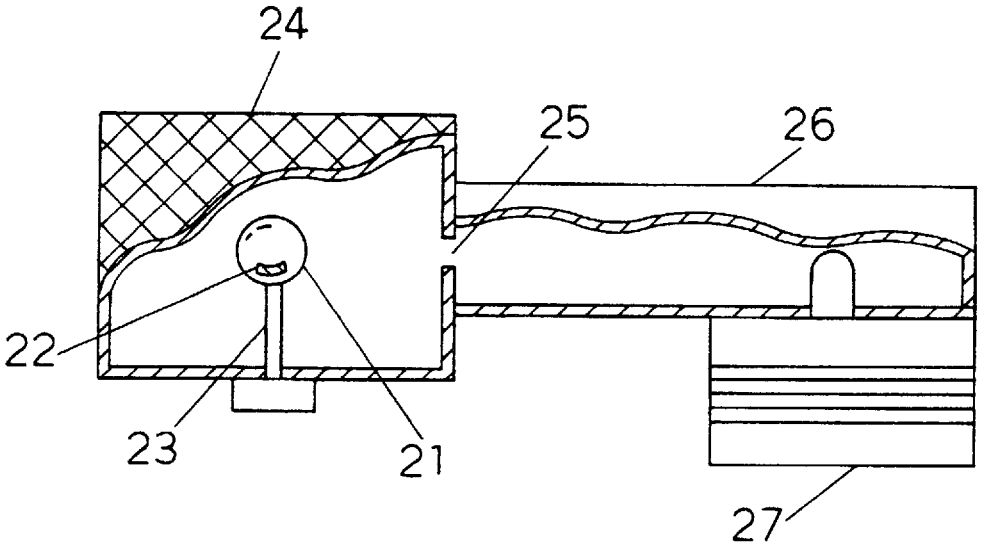
FIG. 2 is a schematic diagram of a microwave electrodeless discharge lamp system according to the present invention.

The construction and operation of the microwave electrodeless discharge system used in the invention for obtaining the emitted radiation shown in FIG. 1 will be described with reference to FIG. 2. The construction of this microwave electrodeless discharge system is substantially the same as that of the high-power lamp disclosed in Japanese Patent Unexamined Publication No. 6-132018. In FIG. 2, the bulb 21 is made of quartz glass and contains a fill 22 such as indium iodide and argon gas. The bulb 21 is supported inside a microwave cavity 24 by means of a supporting pole 23 made of a dielectric material. The supporting pole 23 may be connected to a motor with the axis of the supporting pole aligned with the rotational axis of the motor. In that case, the bulb 21 is rotated at about 1000 to 3600 rpm by the motor. In this embodiment, the emission spectrum shown in FIG. 1 was obtained by causing the fill 22 inside the bulb 21 to emit light while rotating the bulb 21 at 3600 rpm. This arrangement serves to maintain the bulb at uniform temperature and stabilize the discharge plasma. The microwave energy produced by a magnetron 27 is supplied through a waveguide 26 communicating with an coupling slot 25 of the microwave cavity 24. The microwave energy thus supplied excites the fill 22 inside the bulb 21, causing a plasma state and thereby emitting light. By constructing the microwave cavity 24 using a conductive mesh or the like so formed as to substantially block the microwave energy and to substantially transmit the light produced within the bulb 21, the produced light can be extracted outside the microwave cavity 24 while preventing the microwave energy from leaking outside the microwave cavity 24.

According to the present embodiment, as shown in FIG. 1, luminous radiation having an intense continuous spectrum over the entire visible region can be obtained from indium iodides. Line spectra of blue portions at 410 nm and 451 nm emitted from the indium element are well known as the emission spectra of indium iodides by high intensity discharge. These line spectra are usually used to increase the intensity of blue radiation of a metal halide lamp. In the present embodiment, however, the line spectra of the indium element are greatly reduced, and the continuous spectrum of molecular radiation appears over the entire visible region. As a result, a source of white light providing high efficacy and outstanding color rendering properties can be obtained.

For comparison of color rendering properties, a prior art example of an electroded metal halide lamp will be described first. A metal halide lamp containing Hg+InI+TlI+NaI and consisting primarily of line spectra has a general color rendering index $R_a$ of about 60 and a special color rendering index $R_9$ of about −150, the latter being a measure of the color appearance of vivid red. The efficacy of the lamp is about 80 lm/W. Color rendering properties are low for all light colors, and it can be said that the reproducibility of vivid red, among others, is almost zero. According to the present embodiment, on the other hand, the general color rendering index $R_a$ was 96, and the efficacy of the lamp was about 100 lm/W, and the special color rendering index $R_9$, which serves as a measure of vivid red color appearance and is difficult to achieve a high value, was 77. In this way, the lamp of the present embodiment provides very excellent color rendering properties and excellent luminous efficacy at the same time.

Another advantage of the electrodeless HID lamp of the invention is the use of only one kind of fill as the primary source of discharge radiation. Conventional metal halide lamps contain fills consisting of several kinds of metals and metal halides to produce white light. Partial pressures of these metal additives are determined by the amount of each fill in the lamp and the temperature of the coldest portion of the bulb. However, the parameters of the amount of fills and the temperature of the coldest portion both change because of such factors as manufacturing tolerances and aging. This affects the optical characteristics, such as total luminous flux and chromaticity, of emitted radiation.

For example, metal halide lamps containing fills of Hg+InI+TlI+NaI, etc. produce white light by combining blue of the In element, green of the Tl element, and yellow of the Na element; accordingly, differences in fill amounts greatly affect the color balance and output characteristics. It has been pointed out, however, that metals such as Na, Sc, and Dy widely used in metal halide lamps react with the quartz glass used for the lamp envelope during operation and gradually reduce the amount of fills effective for producing the discharge. As a result, lamp color shifts and light output drops as the lamp ages. On the other hand, according to the lamp of the present invention, the use of only one kind of metal halide minimizes the effects of manufacturing tolerances and aging on the color characteristics of the lamp.

Table 1 shows several examples of emission characteristics of bulbs when the amount of indium iodide and the amount of indium bromide are varied from bulb to bulb. All the bulbs shown here were operated with an input electrical energy of 800 W while being rotated at 3000 to 3600 rpm in the microwave electrodeless discharge system shown in FIG. 2.

TABLE 1

| InX fill amount ($\times 10^{-5}$ mol/cm) | | Ar fill amount (Torr) | Lamp efficacy (Im/W) | General color rendering index $R_a$ | Special color rendering index $R_9$ | Correlated color temperature (K) |
|---|---|---|---|---|---|---|
| Inl | 1.1 | 50 | 61 | 97 | 95 | 7,930 |
| Inl | 2.2 | 5 | 101 | 96 | 77 | 5,470 |
| Inl | 2.2 | 50 | 92 | 97 | 81 | 5,760 |
| Inl | 4.4 | 50 | 93 | 91 | 66 | 4,590 |
| InBr | 1.4 | 10 | 51 | 93 | 71 | 11,510 |
| InBr | 2.7 | 10 | 88 | 97 | 93 | 7,330 |
| InBr | 5.4 | 10 | 84 | 97 | 93 | 5,930 |

It can be seen that, for the same fill amount, a lamp with indium bromide has a higher correlated color temperature than a lamp with indium iodide. The earlier described example of the embodiment is shown in the second row. It is shown that the color rendering index values can be further improved by varying the fill amount, etc. A maximum value of 95 was achieved for the special color rendering index $R_9$ which indicates the color appearance of vivid red.

For both indium iodide and indium bromide, the tendency is such that the correlated color temperature decreases with increasing fill amount. This is because the peak wavelength in the continuous spectrum of molecular radiation of indium halides shifts toward the longer wavelength side as the fill amount increases. It is believed that this happens because the internuclear distance of indium halide molecules reduces as the molecular weight of indium halides increases during operation, and as a result, the difference in energy of transition decreases. However, the amount of this color shift is not sensitive to minor variations and does not present a problem in terms of the manufacturing tolerances previously described.

On the contrary, this characteristic allows greater freedom in designing the correlated color temperature. It is therefore possible to design lamps with correlated color temperatures suitable for various application fields. For example, for alight source for a liquid-crystal video projector, a lamp with a relatively high correlated color temperature above 7000 K is needed in order to emphasize emission of blue radiation. The electrodeless HID lamp of the present invention can meet such needs by changing the fill amount of indium halides.

Color rendering properties and correlated color temperature are determined by the spectral distribution of the light emitted from the discharge arc, and lamp efficacy also is greatly affected. The spectral distribution is largely determined by the arc temperature. According to W. Elenbaas, "The High Pressure Mercury Vapour Discharge," North Holland Publishing Company (1951), the effective temperature $T_{eff}$ of an arc in a high-pressure mercury discharge lamp is expressed by the following equation.

$$T_{eff} = \frac{eV_a/k}{\ln(\gamma C_1) - \ln\{(P - P_{cond})/m\}} \quad \text{[Equation 1]}$$

where P is input electrical energy per unit length of the arc (e.g., W/cm), $P_{cond}$ is heat conduction loss per unit length of the electrode-to-electrode distance of the arc (e.g., W/cm), m is the fill amount of mercury per unit length of the electrode-to-electrode distance of the arc (e.g., mg/cm), k is the Boltzmann constant, and e is an electric charge, $V_a$ is the average excitation potential of mercury, and $C_1$ and $\gamma$ are constants. An actual discharge arc has a temperature distribution such that the temperature is the highest at the center in the diameter of the tube and decreases as it nears the tube wall. Here, a uniform effective temperature $T_{eff}$ is specified for simplicity, and the calculation is made by approximation, using a cylindrically shaped arc assuming the electrode-to-electrode distance to be the arc length.

The above example is concerned with a high-pressure mercury arc lamp, but for an electrodeless HID lamp as shown in the present embodiment also, the spectral characteristics can likewise be determined by approximation using the input energy and the fill amount of luminescent substances per unit length of the arc. However, since the electrodeless HID lamp does not have electrodes, the arc length between the electrodes is replaced by the arc's effective length in the direction of the electric field of the input electrical energy. To derive the arc's effective length, an average value must be calculated from the temperature distribution of the arc, but since the temperature distribution varies depending on the fill amount of the arc and the input energy, this method is very complicated and not suitable as design means.

It is believed that in an electrodeless HID lamp, the arc size varies almost in proportion to the inner wall-to-wall distance of the bulb (inner diameter in the case of a spherical bulb). Accordingly, if the arc length is approximated by the inner wall-to-wall distance of the bulb in the direction of the electric field of the input electrical energy, and the input electrical energy and the fill amount per unit length are determined, approximate spectral characteristics can be obtained. Based on the above principle, we measured changes in the spectral characteristics against changes in luminescent substances and the input electrical energy per unit length of the inner wall-to-wall distance of the bulb in the direction of the electric field, and determined optimum values. This provides an index when varying the discharge bulb shape in various ways, and makes efficient design work possible. The following describes how lamp efficacy and general color rendering index $R_a$ change with the fill amount of indium halides and the input energy per unit length of the inner wall-to-wall distance of the bulb in the direction of the electric field of the input electrical energy.

Figure 3:
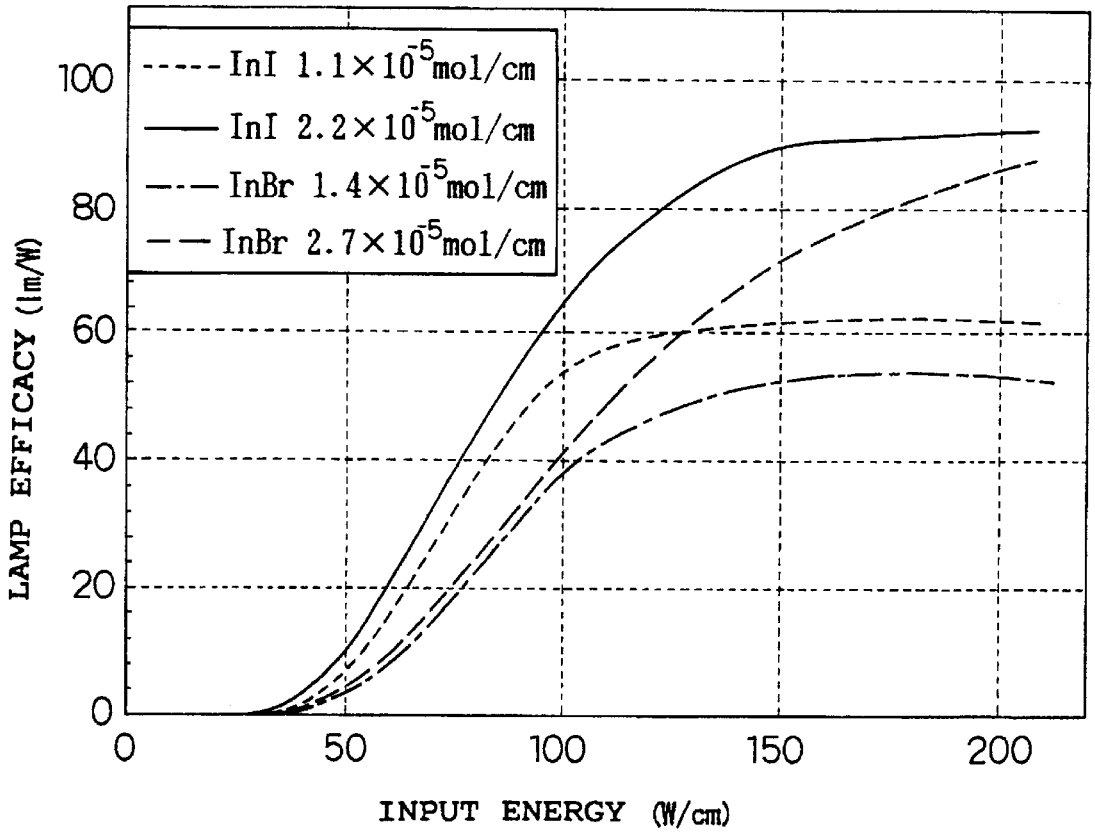
FIG. 3 is a diagram showing correlation between energy input and luminous efficacy for electrodeless discharge lamps filled with indium halides and argon according to the first embodiment of the present invention.
Figure 4:
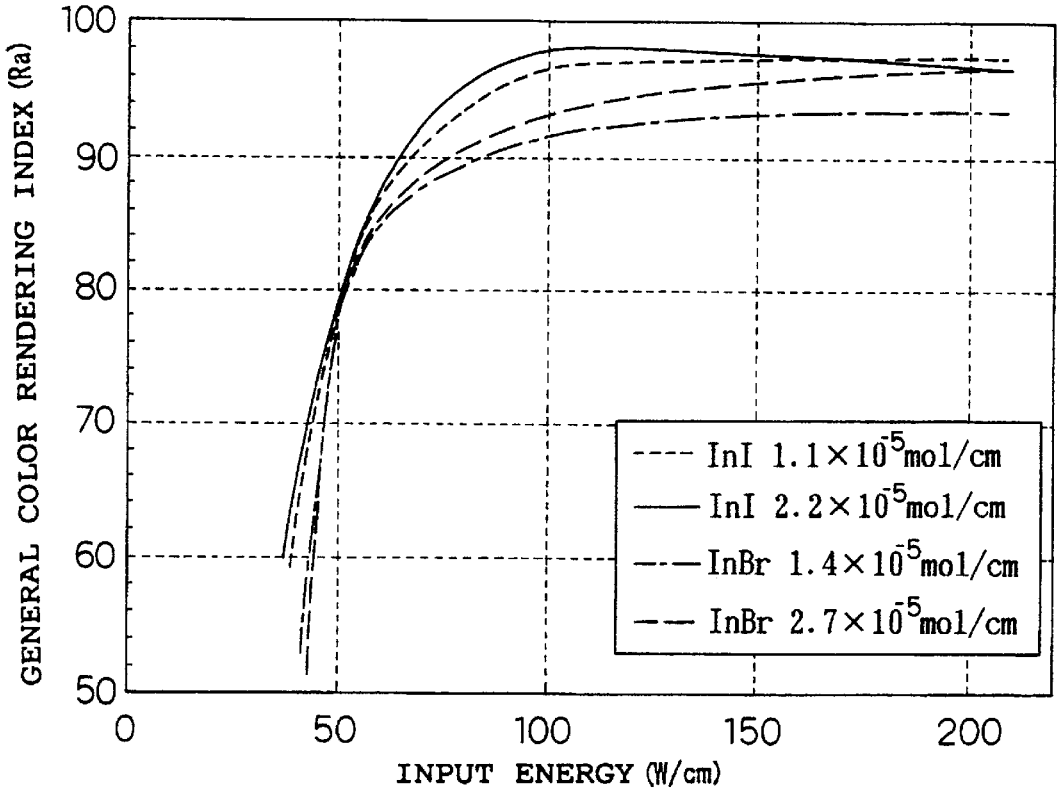
FIG. 4 is a diagram showing correlation between energy input and general color rendering index for electrodeless discharge lamps filled with indium halides and argon according to the first embodiment of the present invention.

FIGS. 3 and 4 are graphs showing the effect of input energy on the optical characteristics of lamps. A total of four lamps were prepared, each constructed with a spherical electrodeless discharge bulb of quartz glass having an inner diameter of 3.8 cm. Two lamps were filled with argon gas at 50 torr and indium iodide at $1.1\times10^{-5}$ mol or $2.2\times10^{-5}$ mol, respectively, per centimeter of the bulb inner diameter, and the remaining two lamps were filled with argon gas at 10 torr and indium bromide at $1.4\times10^{-5}$ mol or $2.7\times10^{-5}$ mol, respectively, per centimeter of the bulb inner diameter. FIGS. 3 and 4 respectively show how the lamp efficacy and general color rendering index vary when input energy to each lamp is varied in the microwave electrodeless discharge lamp system shown in FIG. 2. Each lamp was operated by being rotated at 3600 rpm by the motor, as in the earlier described example of the embodiment.

As can be seen from FIG. 3, the luminous efficacy of each lamp rises as the input electrical energy of the microwave to the lamp increases. There is a saturation point on the rise of the luminous efficacy. This saturation point shifts to a higher input electrical energy region as the fill amount is increased.

Shown in FIG. 4 is the variation of the general color rendering index $R_a$ with the input electrical energy per unit length of the bulb inner diameter. In regions where the input electrical energy is about 50 W/cm or greater, $R_a$ takes a value of 80 or greater which is sufficient for general-lighting applications. When the input electrical energy density is about 100 W/cm or greater, and preferably about 150 W/cm or greater, excellent color rendering properties and high efficacy can be achieved simultaneously.

In a region where the input electrical energy density is low, a sufficient amount of indium iodide has not yet been vaporized within the bulb, which is one reason for low efficacy and low color rendering properties. In this low energy region, since plasma pressure is still low, the line spectrum of the indium element is a predominant light source. As a result, satisfactory efficacy and color rendering properties cannot be obtained.

Figure 5:
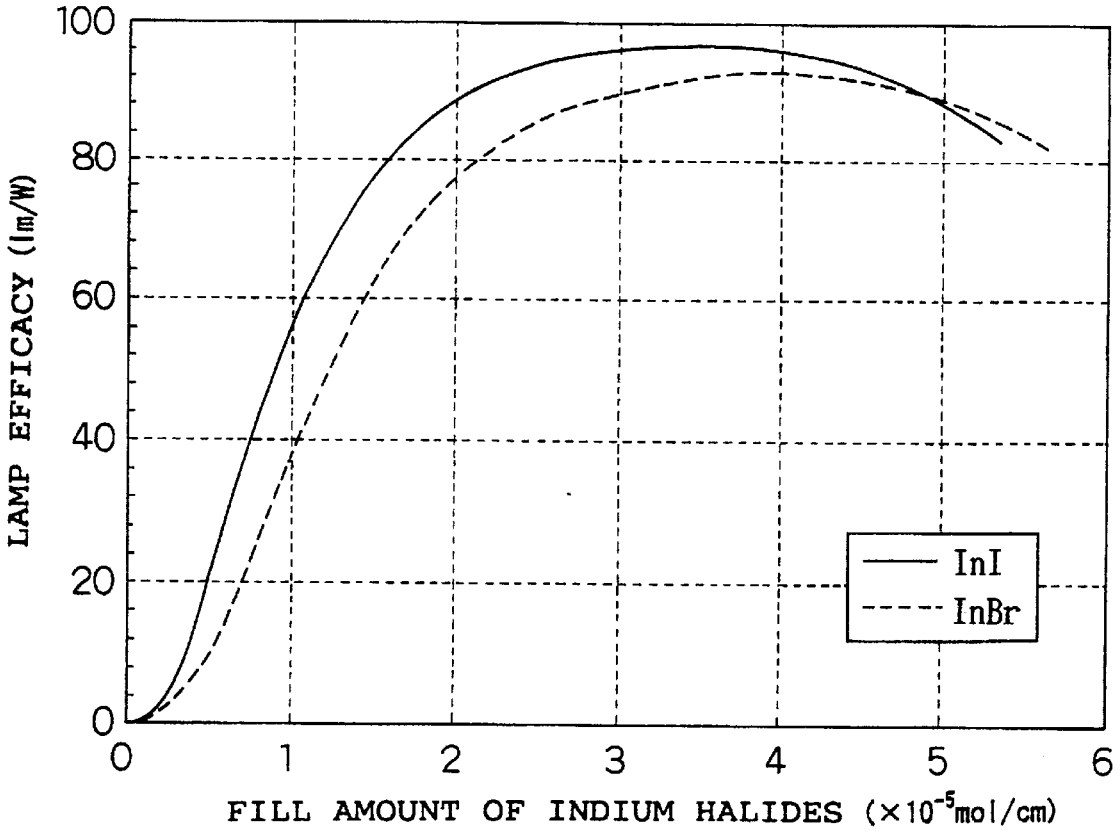
FIG. 5 is a diagram showing correlation between the fill amount of indium halides and luminous efficacy for electrodeless discharge lamps filled with indium halides and argon according to the first embodiment of the present invention.
Figure 6:
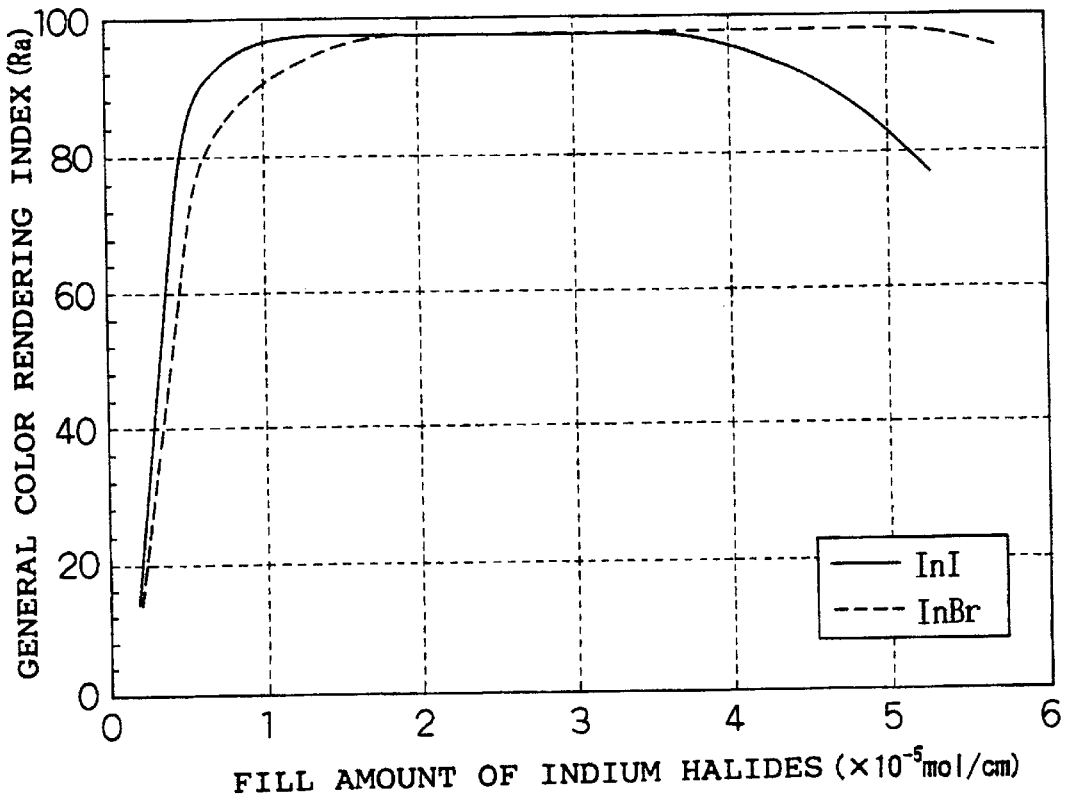
FIG. 6 is a diagram showing correlation between the fill amount of indium halides and general color rendering index for electrodeless discharge lamps filled with indium halides and argon according to the first embodiment of the present invention.

FIGS. 5 and 6 respectively show how the lamp efficacy and general color rendering index $R_a$ vary when the fill amount of indium iodide or indium bromide is varied. The bulb shape and the operating conditions are the same as described in connection with FIGS. 3 and 4. Input electrical energy per unit length of the bulb inner diameter was 210 W/cm. The solid line shows the variation of efficacy with the fill amount, while the dotted line shows the variation of general color rendering index. When the fill amount is about $0.5\times10^{-5}$ mol/cm or larger, the general color rendering index is above 80 which is a value sufficient for general-lighting applications. When the fill amount is about $2\times10^{-5}$ mol/cm or larger, a high efficacy of 90 lm/W or over and a high color rendering index of 95 or over can be achieved simultaneously.

Accordingly, for general-lighting applications, it is desirable that the fill amount of indium iodide be set within this region. However, when the fill amount is about $5\times10^{-5}$ mol/cm or larger in the case of indium iodide, and about $7\times10^{-5}$ mol/cm or larger in the case of indium bromide, the general color rendering index drops to 80 or lower value, and the lamp efficacy also drops. Filling an excessive amount of indium halides is therefore not desirable for general-lighting applications.

(Embodiment 2)

Figure 7:
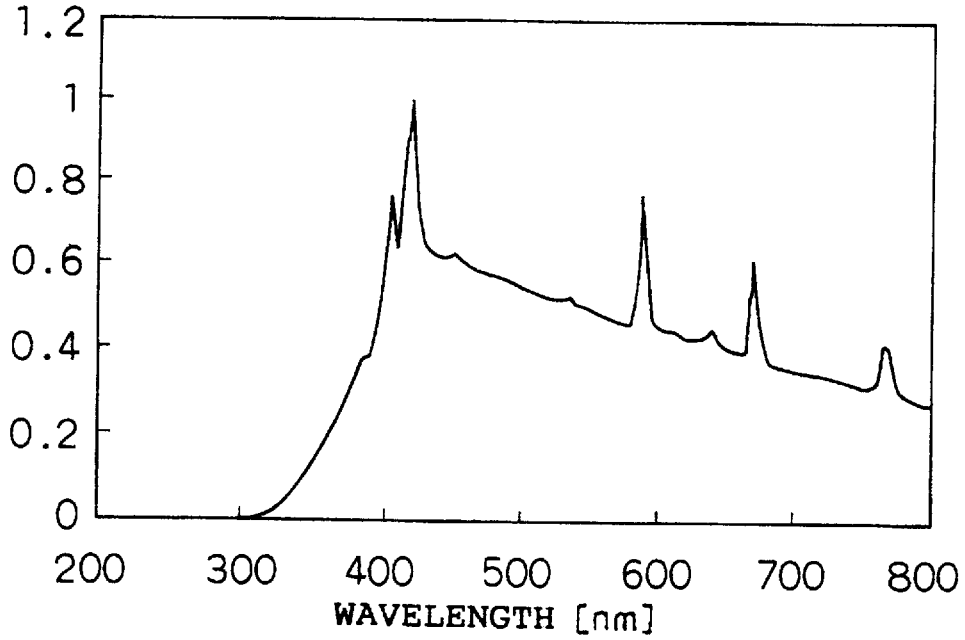
FIG. 7 is a diagram showing the emission spectrum of an electrodeless discharge lamp filled with gallium iodide and argon according to a second embodiment of the present invention.

A second embodiment of the present invention will be described below with reference to drawings. FIG. 7 shows an emission spectrum obtained when a lamp, constructed with a spherical electrodeless discharge bulb of quartz glass having an inner diameter of 2.8 cm and filled with argon gas at 2 torr and gallium iodide ($GaI_3$) at $2.6\times10^{-5}$ mol/cm per unit length of the inner diameter, was operated in the microwave electrodeless HID lamp system shown in FIG. 2, as in the first embodiment, with an input microwave energy of 550 W to produce light by discharge.

In the second embodiment, however, the mechanism for rotating the bulb is not used. The emission spectrum shown in FIG. 5 is a plot of the intensity of radiation measured at intervals of 5 nm, as in FIG. 1.

Here, a continuous spectrum was obtained by molecular radiation, which consisted of the line spectra of the gallium element at 403 nm and 417 nm and the line spectra of sodium, lithium, and potassium, the impurities contained therein.

As for the characteristics of the lamp of the present embodiment, the lamp luminous efficacy was 43 lm/W, the general color rendering index $R_a$ was 96, and the correlated color temperature was 6920 K. Since the continuous spectrum produced by gallium halides has a peak in a shorter wavelength region than the continuous spectrum of indium halides, a higher correlated color temperature results. This characteristic is suited for applications where a lamp with a high correlated color temperature is required, such as a light source for liquid-crystal video projection. It is also possible to vary the correlated color temperature or other characteristics by adding indium halides.

For electrodeless lamps filled with gallium iodide or gallium bromide, when the fill amount or the input electrical energy is varied, the optical characteristics change in the same manner as observed on the indium halide lamps in the first embodiment.

In the first and second embodiments of the present invention described above, the halides of indium and gallium are used as metal halides that emit a continuous spectrum by molecular radiation. Alternatively, thallium halides may be used in the same way as the above-mentioned halides as metal halide additives that emit a continuous spectrum by molecular radiation.

(Embodiment 3)

Figure 8:
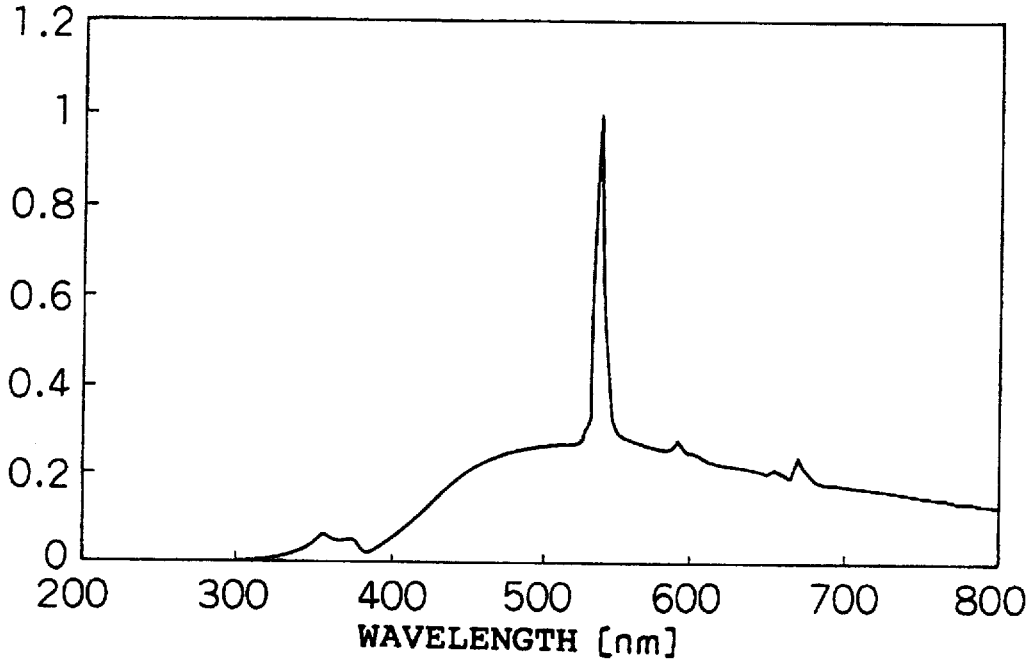
FIG. 8 is a diagram showing the emission spectrum of an electrodeless discharge lamp filled with zinc and TlI according to a third embodiment of the present invention.

A third embodiment of the present invention will be described below with reference to drawings. FIG. 8 shows an emission spectrum obtained when a lamp, constructed with a spherical electrodeless discharge bulb of quartz glass having an inner diameter of 2.8 cm and filled with argon gas at 2 torr, 40 mg of zinc ($2.2\times10^{-4}$ mol/cm), and 8 mg of TlI ($0.9\times10^{-5}$ mol/cm) per unit length of the inner diameter, was operated in the microwave electrodeless HID lamp system shown in FIG. 2 with an input microwave energy of 300 W to produce light by discharge.

According to the present embodiment, emission of luminous radiation can be obtained with the line spectrum of Tl at 535 nm superimposed on a continuous spectrum extending over the entire visible region, as shown in FIG. 8. If the lamp is filled with argon gas and Tl only so that luminous radiation is produced mainly with the line spectrum at 535 nm, the general color rendering index $R_a$ will drop to 15 or lower, which is not suitable for general lighting. On the other hand, the construction of the present embodiment achieves a general color rendering index $R_a$ of 84, showing a dramatic improvement.

TABLE 2

| Fill amount(mg) | | | | Input energy | Efficacy | Color rendering | Color temperature | CIE color coordinates | |
|---|---|---|---|---|---|---|---|---|---|
| Zn | InI | T1I | NaI | (W) | (lm/W) | index Ra | (K) | (x) | (y) |
| 0 | | 8 | | 300 | 26 | 77 | 6,750 | 0.299 | 0.385 |
| 2 | | 8 | | 300 | 35 | 75 | 6,430 | 0.305 | 0.401 |
| 5 | | 8 | | 300 | 46 | 76 | 6,330 | 0.308 | 0.399 |
| 20 | | 8 | | 300 | 47 | 80 | 5,930 | 0.319 | 0.403 |
| 40 | | 8 | | 300 | 54 | 82 | 5,700 | 0.327 | 0.401 |
| 20 | 6 | | | 300 | — | 87 | 14,480 | 0.282 | 0.247 |
| 20 | 6 | 8 | 4 | 300 | — | 80 | 4,930 | 0.349 | 0.381 |
| 20 | 10 | 5 | 1 | 250 | — | 85 | 6,020 | 0.321 | 0.336 |

Further, as shown in Table 2, luminous efficacy is more than two times as high as that of a lamp designed to emit continuous light by high intensity discharge without containing zinc. This is because the emission in the continuous spectrum portion is greatly increased although there is no significant change in the intensity of the line spectrum at 535 nm. This is believed to be due to the presence of zinc contributing to increased bulb internal pressure. It is thus shown that high efficacy can be achieved with the addition of zinc.

(Embodiment 4)

Figure 9:
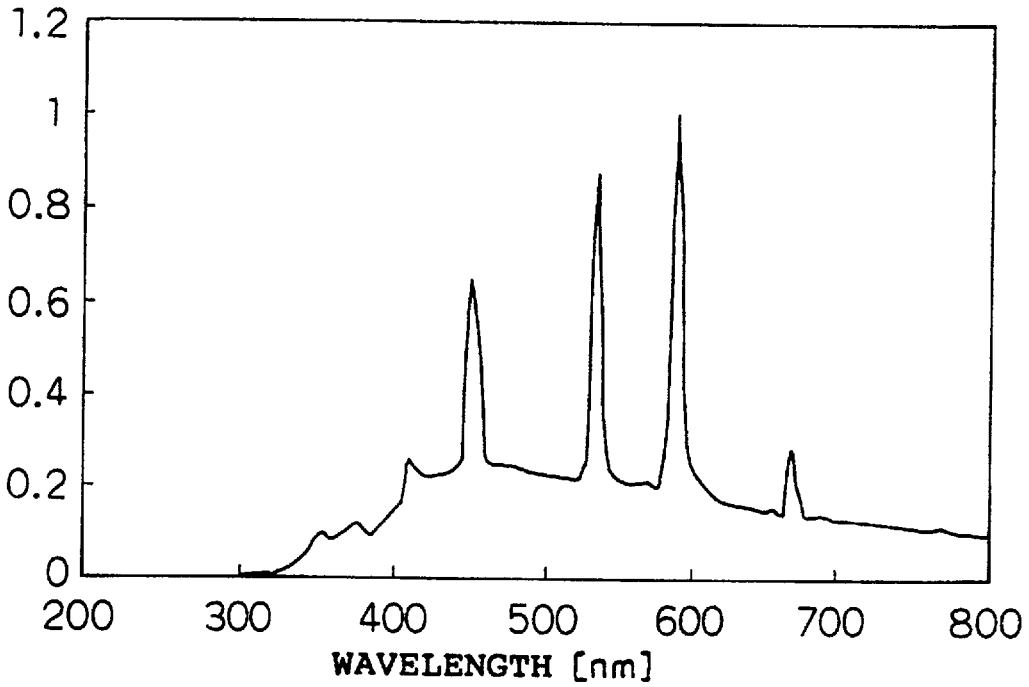
FIG. 9 is a diagram showing the emission spectrum of an electrodeless discharge lamp filled with zinc, InI, TlI, and NaI according to a fourth embodiment of the present invention.

A fourth embodiment of the present invention will be described below with reference to drawings. FIG. 9 shows an emission spectrum obtained when a lamp, constructed with a spherical electrodeless discharge bulb of quartz glass having an inner diameter of 2.8 cm and filled with 20 mg of zinc ($1.1\times10^{-4}$ mol/cm), 10 mg of InI ($1.5\times10^{-5}$ mol/cm), 5 mg of TlI ($0.5\times10^{-5}$ mol/cm), 1 mg of NaI ($0.2\times10^{-5}$ mol/cm), and argon gas at 2 torr, was operated in the microwave electrodeless. HID lamp system shown in FIG. 2 with an input of 250 W to produce light by discharge. In the present embodiment, emission of luminous radiation was obtained with the line spectra of In, Tl, and Na superimposed on the continuous spectrum. Emission of white light with chromaticity (x, y) of (0.321, 0.336) can be obtained, with a general color rendering index $R_a$ of 85.

Discharge emission characteristics under other fill conditions according to the third and fourth embodiments are shown in Table 2 for comparison.

Since desired operating pressure suitable for luminous radiation of metal halides can be obtained by using zinc as a fill without using mercury, the kinds of metal halide fills are not limited to those given in the above embodiments. For example, by adding LiI and using the line spectrum at 670 nm, a further improvement in color rendering properties can be achieved.

In all of the above embodiments, it is apparent that harmful UV radiation beyond 350 nm, which is a problem with HID mercury lamps, is greatly suppressed. UV radiation from conventional metal halide lamps was mostly due to the line spectrum of mercury. Containing no mercury naturally offers the above effect. This provides an important advantage for the enhancement of safety for human bodies in general-lighting applications and for the protection of exhibits in museums and art galleries.

In the first to fourth embodiments, quartz glass was used as the light transmitting material of the bulb 21 shown in FIG. 2, but it will be appreciated that the bulb material is not limited to quartz glass. For example, by using a light transmitting alumina ceramic material as the bulb material, the heat resistance of the bulb can be improved. Thus the bulb can be made to withstand higher temperature and higher pressure, making operation possible with higher input electrical energy.

This also allows the elimination of the previously described bulb rotating mechanism, making it possible to improve system efficiency and reduce the manufacturing cost of the electrodeless HID lamp system.

Furthermore, it will be recognized that the electrodeless HID lamp of the invention, illustrated in the first to fourth embodiments, is also applicable for use in an electrodeless HID lamp system, such as the one disclosed in Japanese Patent Unexamined Publication No. 3-152852, in which the fill is excited for discharge by RF-inductive coupling.

As described above, according to the present invention, by utilizing an intense continuous emission spectrum produced by molecular radiation of metal halides, an excellent electrodeless HID discharge lamp and electrodeless HID discharge lamp system can be obtained that have long life and outstanding color rendering properties and high efficacy optical characteristics without having to use mercury.

What is claimed is:

1. An electrodeless HID (high-intensity-discharge) lamp comprising:

a light transmitting bulb for confining a discharge therein;

a fill sealed within said light transmitting bulb and including a rare gas and a metal halide emitting a continuous spectrum by molecular radiation; and a discharge excitation means for applying electrical energy to said fill and for starting and sustaining an arc discharge;

wherein:

said metal halide includes one kind of halide selected from the group consisting of an indium halide, a gallium halide, and a thallium halide, or a mixture thereof, and said metal halide also contains a halogen selected from the group consisting of iodine, bromine, and chlorine, or a mixture thereof;

said rare gas includes an element from the group consisting of Ar, Kr, and Xe, or a mixture thereof;

the amount of the metal halide fill is substantially $0.5\times10^{-5}$ mol or greater per centimeter of the inner wall-to-wall distance of said light transmitting bulb in a direction of the electric field of said electrical energy applied from said discharge excitation means; and said light transmitting bulb has no electrodes exposed in discharge space.

2. An electrodeless HID lamp according to claim 1, wherein said electrical energy applied from said discharge excitation means is substantially 50 W or over per centimeter of an inner wall-to-wall distance of said light transmitting bulb in a direction of an electric field of said electrical energy applied from said discharge excitation means.

3. An electrode HID lamp comprising:

a light transmitting bulb for confining a discharge therein;

a fill sealed within said light transmitting bulb and including zinc, a rare gas, and a metal halide emitting a continuous spectrum by molecular radiation; and a discharge excitation means for applying electrical energy to said fill and for starting and sustaining an arc discharge;

wherein:

said metal halide includes one kind of halide selected from the group consisting of an indium halide, a gallium halide, and a thallium halide, or a mixture therefore, and said light transmitting bulb has no electrodes exposed in discharge space, the amount of said zinc sealed within said light transmitting bulb is substantially $5\times10^{-5}$ mol or greater per centimeter of an inner wall-to-wall distance of said light transmitting bulb in a direction of an electric field of said electrical energy applied from said discharge excitation means; and the amount of the metal halide fill is substantially $0.5\times10^{-5}$ mol or greater per centimeter of the inner wall-to-wall distance of said light transmitting bulb in a direction of the electric field of said electrical energy applied from said discharge excitation means.

4. An electrodeless HID lamp according to claim 3, wherein said electrical energy applied from said discharge excitation means is substantially 50 W or over per centimeter of an inner wall-to-wall distance of said light transmitting bulb in a direction of an electric field of said electrical energy applied from said discharge excitation means.

5. An electrodeless HID lamp system which uses an electrodeless HID lamp as described in claim 1, wherein said discharge excitation means is a means for coupling microwave energy to said fill.

6. An electrodeless HID lamp system which uses an electrodeless HID lamp as described in claim 3, wherein said discharge excitation means is a means for coupling microwave energy to said fill.

7. An electrodeless HID lamp system which uses an electrodeless HID lamp as described in claim 1, wherein said discharge excitation means is a means for inductively coupling RF energy to said fill.

8. An electrodeless HID lamp system which uses an electrodeless HID lamp as described in claim 3, wherein said discharge excitation means is a means for inductively coupling RF energy to said fill.

9. A fill sealed within a light transmitting bulb for use in an electrodeless HID lamp comprising:

a rare gas and a metal halide emitting a continuous spectrum by molecular radiation;

wherein said metal halide includes a halide selected from the group consisting of an indium halide, a gallium halide, and a thallium halide, or a mixture thereof.

10. A fill according to claim 9, wherein said metal halide contains a halogen selected from the group consisting of iodine, bromine, and chlorine, or a mixture thereof, and said rare gas includes an element selected from the group consisting of Ar, Kr, and Xe, or a mixture thereof.

* * * * *

UNITED STATES PATENT AND TRADEMARK OFFICE

CERTIFICATE OF CORRECTION

PATENT NO. : 5,864,210
DATED : January 26, 1999
INVENTOR(S) : Hochi et al.

It is certified that error appears in the above-identified patent and that said Letters Patent is hereby corrected as shown below:

Cover page, item [56] References Cited, Other Publications, insert --P.C. Drop, et al., "Some Aspects of the Tin Halide Molecular Arc", *Lighting Research and Technology,* vol. 6, no. 4, pp. 212-216 (1974).--

Signed and Sealed this

Fourteenth Day of September, 1999

*Attest:*

Q. TODD DICKINSON

*Attesting Officer*

*Acting Commissioner of Patents and Trademarks*